United States Patent [19]

Shih

[11] Patent Number: 4,856,694

[45] Date of Patent: Aug. 15, 1989

[54] PAPER SHIFTING APPARATUS FOR TOILET SEATS

[76] Inventor: Lei-Chen Shih, No. 1, 12th Fl., Chung-Hsiao E. Rd., Sec. 5, Taipei, Taiwan

[21] Appl. No.: 203,428

[22] Filed: Jun. 7, 1988

[51] Int. Cl.[4] ..... B65H 20/02; A47K 13/18

[52] U.S. Cl. ..... 226/134; 226/136; 4/247

[58] Field of Search ..... 226/134, 136, 110, 108; 4/242, 243, 247

[56] References Cited

U.S. PATENT DOCUMENTS

| | | | |
|---|---|---|---|
| 1,967,581 | 7/1934 | Mactas | 4/247 |
| 2,024,088 | 1/1933 | Benson | 4/247 |
| 3,737,087 | 6/1973 | Rooklyn | 226/110 |
| 3,961,386 | 6/1976 | Beno | 4/247 |
| 4,369,906 | 1/1983 | Isherwood | 226/108 X |
| 4,766,618 | 8/1988 | Boker | 4/247 |
| 4,769,859 | 9/1988 | Bobak | 4/242 X |

FOREIGN PATENT DOCUMENTS

| | | | |
|---|---|---|---|
| 88814 | 12/1896 | Fed. Rep. of Germany | 4/242 |
| 660709 | 1/1936 | Fed. Rep. of Germany | 4/247 |

*Primary Examiner*—Stuart S. Levy
*Assistant Examiner*—Philip Han
*Attorney, Agent, or Firm*—Ladas & Parry

[57] ABSTRACT

A paper shifting apparatus for toilet seats includes; a supply mechanism with a pair of rollers pivotally installed in a supply case which is adapted to be fixed at a proper place close to one side of a toilet bowl; a take-up mechanism with a pair of rollers pivotally provided in a taki-up case to be positioned at a place close to another side of the toilet bowl; a continuous toilet-seat covering paper prepared in a stack in the supply case having a feed portion and a running portion movably arranged between the supply mechanism and the take-up mechanism for being rotatably moved piece by piece over the toilet seat; a fine adjusting device fixed at an axial end of the take-up mechanism; and a locating and driving device installed in the take-up case and mechanically coupled with the take-up mechanism; so that, by starting the locating and driving device, the take-up mechanism will be driven to effect the replacement of one piece of the continuous toilet-seat covering paper.

1 Claim, 1 Drawing Sheet

PAPER SHIFTING APPARATUS FOR TOILET SEATS

BACKGROUND OF THE INVENTION

This invention relates to a shifting apparatus, and more particularly to a paper shifting apparatus designed to automatically replace a continuous toilet-seat covering paper on toilet seats.

The development of modern toilet fixtures constitutes one of the most remarkable improvements in the living conditions of human beings. Unfortunately, so far as the inventor knows, no steps have been taken to improve the sanitary conditions of toilet seats. Today the only sanitation precautions available are the cleaning operations performed by the users with toilet paper and manually applied cleansers. In order to solve this sanitary problem, a paper toilet-seat covering is developed for personal use. However, as the known paper toilet-seat cover is normally prepared in a roll and placed at a location close to a toilet, to use it, a user has to draw a piece of the paper therefrom and spread it on the toilet seat. This known paper toilet-seat cover is rather inconvenient and often causes stoppage of the toilet bowl after the used paper toilet-seat cover has been dropped into the toilet bowl.

SUMMARY OF THE INVENTION

It is accordingly a primary object of the present invention to provide a paper shifting apparatus by which a continuous toilet-seat covering paper can be automatically laid on a toilet seat and replaced one piece after another.

This and other objects are achieved by the provision of a paper shifting apparatus which comprises: a supply case adapted to be fixed at a place close to one side of a toilet bowl; a supply mechanism pivotally installed in an upper portion of the supply case; a take-up case adapted for being positioned at a place closer to another side of the toilet bowl and located at a same level with that of the supply case; a take-up mechanism pivotally installed in an upper portion of the take-up case; a fine adjusting means operatively disposed at one end of the take-up roller mechanism; a stack of a continuous toilet-seat covering paper having a feed portion movably arranged in the supply case and treaded through the supply mechanism and a running portion rotatably held in the take-up case and treaded through the take-up mechanism with one piece of the toilet-seat covering paper being placed on the toilet seat; and a driving and locating means installed at a proper place in the take-up case and mechanically coupled with the take-up mechanism for being operated to drive the take-up mechanism to rotate a predetermined distance so as to automatically move one piece of the toilet-seat covering paper over the toilet seat as a replacement and achieve the required sanitary purpose.

Other advantages and characteristics of the present invention will become apparent from the following detailed description of a preferred embodiment of a paper shifting apparatus for toilet seats when read in conjunction with the accompanying drawings.

DETAILED DESCRIPTION OF THE PREFERRED EMBODIMENT

Figure 1:
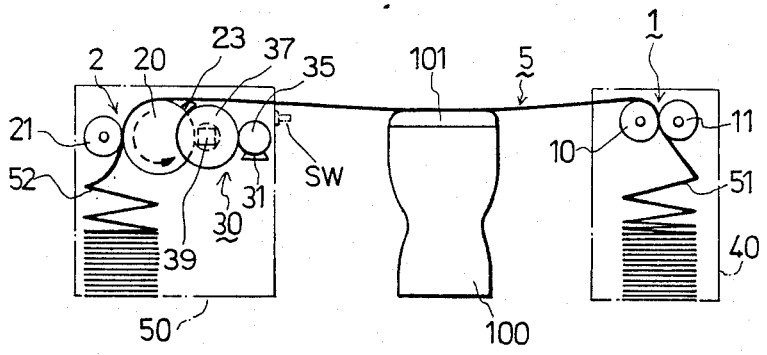
FIG. 1 is a front view of the preferred embodiment of a paper shifting apparatus for toilet seats according to the present invention.
Figure 2:
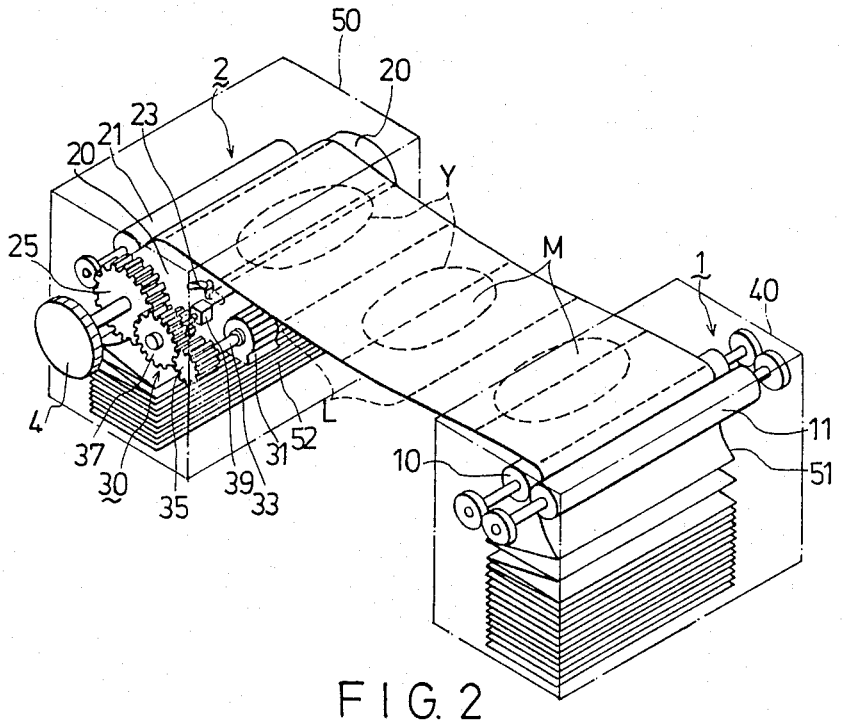
FIG. 2 is a perspective view of the preferred embodiment shown in FIG. 1.

Referring to FIGS. 1, and 2, the preferred embodiment of a paper shifting apparatus for toilet seats according to the present invention comprises in combination: a supply mechanism 1 pivotally installed in a supply case 40; a take-up mechanism 2 pivotally installed in a take-up case 50; a driving and locating means 30 coupled with the take-up mechanism 2; a fine adjusting means 4 connected to the take-up mechanism 2; and a continuous toilet-seat covering paper 5 movably provided between the supply mechanism 1 and the take-up mechanism 2 as shown in FIG. 1.

The supply mechanism 1, which is composed of a first roller 10 and a second roller 11, is pivotally installed in an upper portion of the supply case 40 with both rollers 10 and 11 rotatably coupled with each other. The supply case 40 is fixedly installed at a proper place close to one side of a toilet bowl 100, and positioned in such a way that the top surfaces of the first and second rollers 10 and 11 are located at a level slightly higher than the top level of the toilet seat 101.

The take-up mechanism 2 includes: a third roller 20 and a fourth roller 21 pivotally installed in an upper portion of the take-up casing 50, which is fixed at a place close to another side of the bowl 100 and positioned at the same level as that of the supply case 40 with both rollers 20 and 21 being rotatably coupled with each other; and a locating gear 25 fixed at one end of the third roller 20. The fine adjusting means 4 of which the diameter is similar to that of the third roller 20, is mounted at the axial end of the third roller 20 and movably located on an outer side of the take-up case 50.

The driving and locating means 30 includes: a motor 31 with a power switch sw installed on an inner side of the take-up case 50 and electrically connected to a power source (not shown) thereof; a direct drive gear 35 fixed at an end of the motor shaft 33; a driven gear 37 meshed with both the direct drive gear 35 and the locating gear 25; and a limiting switch 39 installed on the take-up case 50 and electrically coupled with the power source through the power switch sw.

It is to be noted that the limiting switch 39 includes a snap button (not shown) provided on one side facing the third roller 20 and is in conjunction with the protuberance 23 thereof for being actuated to cut off the power source of the motor 31 through the contact of the protuberance 23. On the other hand, the power switch sw, which is connected to the snap button for effecting link-up operation, is installed on an outside of the take-up case 50 for being manually operated to start the motor 31 so as to replace the used toilet-seat covering paper 5. Since the structure and functional arrangement of a limiting siwtch and power switch are well known to those skilled in the art, a detailed description and illustration are omitted for brevity.

The continuous toilet-seat covering paper 5 is folded in a stack and includes a feed portion 51 movably held between the first and second rollers 10 and 11 of the supply roller mechanism 1, and a running portion 52 rotatably gripped between the third and fourth rollers 20 and 21. Each piece of the toilet-seat covering paper 5 is formed with a scratch section M slight less than the middle opening of a toilet seat, and each scratch section M is defined by a perforated line Y along which the scratch section M can be separated and disposed of by a user for convenient use. In this way, every time a scratch section M is open, it indicates that the paper on the toilet seat has been used by someone.

For replacing the used paper, just turn on the power switch sw, the motor 31 will be started so as to drive the third roller 20 to rotate, causing movement of the toilet-seat paper 5, until the snap button (not shown) of the driving and locating means 30 is touched by the protuberance 23 of the third roller 20 so that the power source is turned off. In this way the motor 31 will be immediately stopped, a new piece of the toilet-seat covering paper 5 having been placed on top of the toilet seat 101. However, if the newly replaced piece of the toilet-seat covering paper 5 is not exactly aligned with the toilet seat 101, just manually turn the fine adjusting means 4 to make the necessary adjustments for the alignments. It is to be noted that the diameter of the third roller 20 is equal to the length L of each piece of the continuous toilet-seat covering paper 5 so that each turn of the third roller 20 will move one piece of the continuous toilet-seat covering paper 5 away from the toilet seat 101.

While I have illustrated and described my invention by means of a specific embodiment, it is to be understood that numerous changes and modifications may be made therein without departing from the spirit and scope of the invention as defined in the appending claims.

What I claim is:

1. A paper shifting apparatus for toilet seats comprising:

a supply case adapted to be fixed at a proper place close to one side of a toilet bowl;

a supply mechanism with a first roller and a second roller pivotally installed in an upper portion of said supply case with said first roller and said second roller rotatably coupled with each other therein for being driven to rotate at the same time;

a take-up case adapted to be positioned at a proper place close to another side of the toilet bowl;

a take-up mechanism with a third roller and fourth roller pivotally installed in an upper portion of said take-up case with said third roller and said fourth roller rotatably coupled with each other therein for being driven to rotate at the same time in connection with said supply mechanism;

a locating and driving means installed in said take-up case and mechanically coupled with said take-up mechanism for being electrically operated to drive said take-up mechanism to rotate a predetermined distance; and a continuous toilet-seat covering means having a feed portion at one end in said supply case and a running portion at another end in said take-up case movably arranged between said supply mechanism and said take-up mechanism with one piece of said continuous toilet-seat covering means located over the toilet seat of a toilet bowl, and the length of each piece of said continuous toilet-seat covering means is equal to a diameter of said third roller; so that, by starting said locating and driving means, one piece of said continuous toilet-seat covering means will be automatically shifted over the toilet seat as a replacement.

* * * * *